US005339544A

United States Patent [19]

Caberlotto

[11] Patent Number: 5,339,544

[45] Date of Patent: Aug. 23, 1994

[54] FOOTGEAR STRUCTURE

[75] Inventor: Alberto Caberlotto, Montebelluna, Italy

[73] Assignee: Lotto S.p.A., Montebelluna, Italy

[21] Appl. No.: 117,957

[22] Filed: Sep. 7, 1993

Related U.S. Application Data

[63] Continuation of Ser. No. 765,590, Sep. 25, 1991, abandoned.

[30] Foreign Application Priority Data

Oct. 4, 1990 [IT] Italy ..... 41705 A/90
Apr. 15, 1991 [IT] Italy ..... PD91 A 000071

[51] Int. Cl.[5] ..... A43B 5/02

[52] U.S. Cl. ..... 36/102; 36/127; 36/128; 36/129; 36/43

[58] Field of Search ..... 36/126–130, 36/47, 102, 132, 69, 114, 45, 9 R, 103, 105, 55, 44, 43

[56] References Cited

U.S. PATENT DOCUMENTS

| | | | |
|---|---|---|---|
| 302,930 | 8/1884 | Norton | 36/47 X |
| 460,770 | 10/1891 | Barrows | 36/47 |
| 638,879 | 12/1899 | Packard | 36/69 |
| 737,920 | 9/1903 | Golden | 36/129 |
| 832,855 | 10/1906 | Golden | 36/128 |
| 1,803,554 | 5/1931 | Knilans | 36/114 |
| 2,147,197 | 2/1939 | Glidden | 36/9 R |
| 2,266,697 | 12/1941 | Wilcox | 36/127 |
| 3,040,449 | 6/1962 | Phillips | 36/127 |
| 3,333,353 | 8/1967 | Garcia | 36/69 X |
| 3,341,952 | 9/1967 | Dassler | 36/128 |
| 3,350,795 | 11/1967 | Schlecht | 36/55 X |
| 3,500,561 | 3/1970 | Epstein . | |
| 3,512,274 | 5/1970 | McGrath | 36/127 |
| 3,822,488 | 7/1974 | Johnson | 36/129 |
| 4,040,192 | 8/1977 | Perez | 36/129 X |
| 4,084,279 | 4/1978 | Turner . | |
| 4,132,016 | 1/1979 | Vaccari | 36/114 |
| 4,169,324 | 10/1979 | Gibbs | 36/9 R X |
| 4,179,826 | 12/1979 | Davidson | 36/129 X |
| 4,255,877 | 3/1981 | Bowerman | 36/129 |
| 4,342,161 | 8/1982 | Schmohl | 36/128 X |
| 4,361,971 | 12/1982 | Bowerman | 36/129 |
| 4,385,456 | 5/1983 | Livernois et al. | 36/115 |
| 4,447,967 | 5/1984 | Zaino | 36/87 X |
| 4,535,554 | 8/1985 | De Obaldia B. | 36/102 X |
| 4,574,498 | 3/1986 | Norton et al. | 36/126 X |
| 4,599,810 | 7/1986 | Sacre | 36/83 X |
| 4,706,316 | 11/1987 | Tanzi | 36/55 X |
| 4,779,361 | 10/1988 | Kinsaui . | |
| 4,815,221 | 3/1989 | Diaz . | |
| 4,949,476 | 8/1990 | Anderie | 36/129 |
| 5,014,449 | 5/1991 | Richard et al. | 36/114 |

FOREIGN PATENT DOCUMENTS

| | | | |
|---|---|---|---|
| 0016891 | 10/1980 | European Pat. Off. . | |
| 0569694 | 4/1924 | France | 36/128 |
| 2208279 | 6/1974 | France . | |
| 2386276 | 11/1978 | France . | |
| 2527428 | 12/1983 | France . | |
| 0104552 | 5/1924 | Switzerland | 36/129 |
| 0027800 | of 1905 | United Kingdom | 36/128 |
| 0001740 | of 1913 | United Kingdom | 36/128 |
| 0324098 | 1/1930 | United Kingdom | 36/128 |
| 454290 | 5/1936 | United Kingdom . | |
| 2099283 | 12/1982 | United Kingdom . | |
| 2171890 | 9/1986 | United Kingdom | 36/129 |

*Primary Examiner*—Paul T. Sewell
*Assistant Examiner*—Ted Kavanaugh
*Attorney, Agent, or Firm*—Renner, Kenner, Greive, Bobak, Taylor & Weber

[57] ABSTRACT

The footgear structure includes a first component, made of a single piece of synthetic material, having a rear upper portion which extends from an insole, and a second component having a front upper portion and a lining. The first and second components are mutually united, with the lining accommodated inside the rear upper portion.

26 Claims, 5 Drawing Sheets

FOOTGEAR STRUCTURE

BACKGROUND OF THE INVENTION

This is a continuation of application Ser. No. 07/765,590, filed Sep. 25, 1991, now abandoned.

The invention relates to a footgear structure.

It is known that footgear in general, and sports footgear in particular, must have flexibility and rigidity differentiated by regions for the greater comfort of the foot during use and for a better outcome of athletic movements in case of execution for specific competition use.

In practice, for example in the case of shoes for football, rugby, golf or for similar sports, the front part of the item of footgear must be very flexible and soft, whereas the rear part must be rigid and compact.

This differentiation of the characteristics of the various regions of the item of footgear is currently achieved by interposing layers of material having suitable characteristics between the upper and the lining.

This causes an undesired increase in the weight of the item of footgear, which must be as light as possible for the practice of many sports, and complicates production, consequently increasing the costs thereof.

Another negative aspect is constituted by the considerable number of elements which constitute the item of footgear and which necessarily must be kept in stock for its manufacture.

As regards in particular the foot resting region, current items of footgear furthermore have an assembly insole, made of cardboard or of another equivalent material, above which a structural sole is fitted and below which a tread sole is fitted.

This stratification of elements has, as a negative effect, a reduction in the sensitivity of the foot in the case of footgear intended specifically for competition use.

The material which constitutes the assembly insole furthermore easily absorbs sweat, causing the deformation thereof and consequently deforming the item of footgear.

It is also known that footgear is currently generally manufactured according to a process which, in summary, entails the execution of the upper, which is subsequently fitted and fixed, for example by means of nails, onto an upper-holding last on which said assembly insole is arranged.

The lower edges of the upper are then folded and glued below the assembly insole.

Carding is then performed on the folded edge of the upper and the sole is then assembled, glued and sewn to the assembly insole.

A structural sole is usually placed on the assembly insole.

The manufacture of the item of footgear thus occurs with mutually consecutive operations, for which the upper-holding last constitutes a supporting element as well as a centering and abutment element.

However, although this type of process is extensively used, it has various disadvantages, including a certain slowness in execution, the need for a considerable number of elements to be assembled and the risk of errors in particular in the centering between the sole and the upper.

SUMMARY OF THE INVENTION

The aim of the present invention is to provide an item of footgear having a structure with diversified rigidity and flexibility, composed of a reduced number of elements and having characteristics of extreme lightness.

A primary object is to provide a footgear structure which can be manufactured by means of a process which reduces the number of operations with respect to known types.

An important object is to facilitate and accelerate the production of footgear and to reduce the material which must be kept in stock therefor.

Another important object is to improve the sensitivity of the foot, in particular in the front region, at the same time improving its support in particular in the rear region.

Still another object is to eliminate the risk of deformations currently due to the presence of the assembly insole made of putrescible material.

Another object is to provide a structure wherein a part can be common to the various types and sizes of footgear.

still another object is to provide an item of footgear the execution whereof requires smaller equipment investments than current ones.

Another important object is to provide a footgear structure which allows greater possibilities of automation for the process which manufactures it.

Another important object is to provide a footgear structure which allows to reduce production times and costs.

Not least object is to provide an item of footgear which despite having better technical characteristics than current ones can be marketed at a competitive price.

This aim, these objects and others which will become apparent hereinafter are achieved by a footgear structure as defined in the appended claims.

BRIEF DESCRIPTION OF THE DRAWINGS

Further characteristics and advantages of the invention will become apparent from the detailed description of some embodiments thereof, illustrated only by way of non-limitative example in the accompanying drawings, wherein.

DESCRIPTION OF THE PREFERRED EMBODIMENTS

Figure 1:
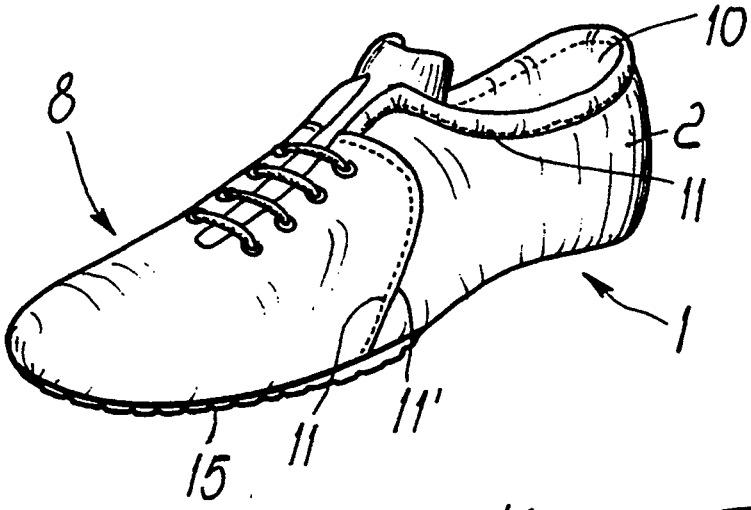
FIG. 1 is a perspective view of a first embodiment of the footgear structure according to the invention.
Figure 2:
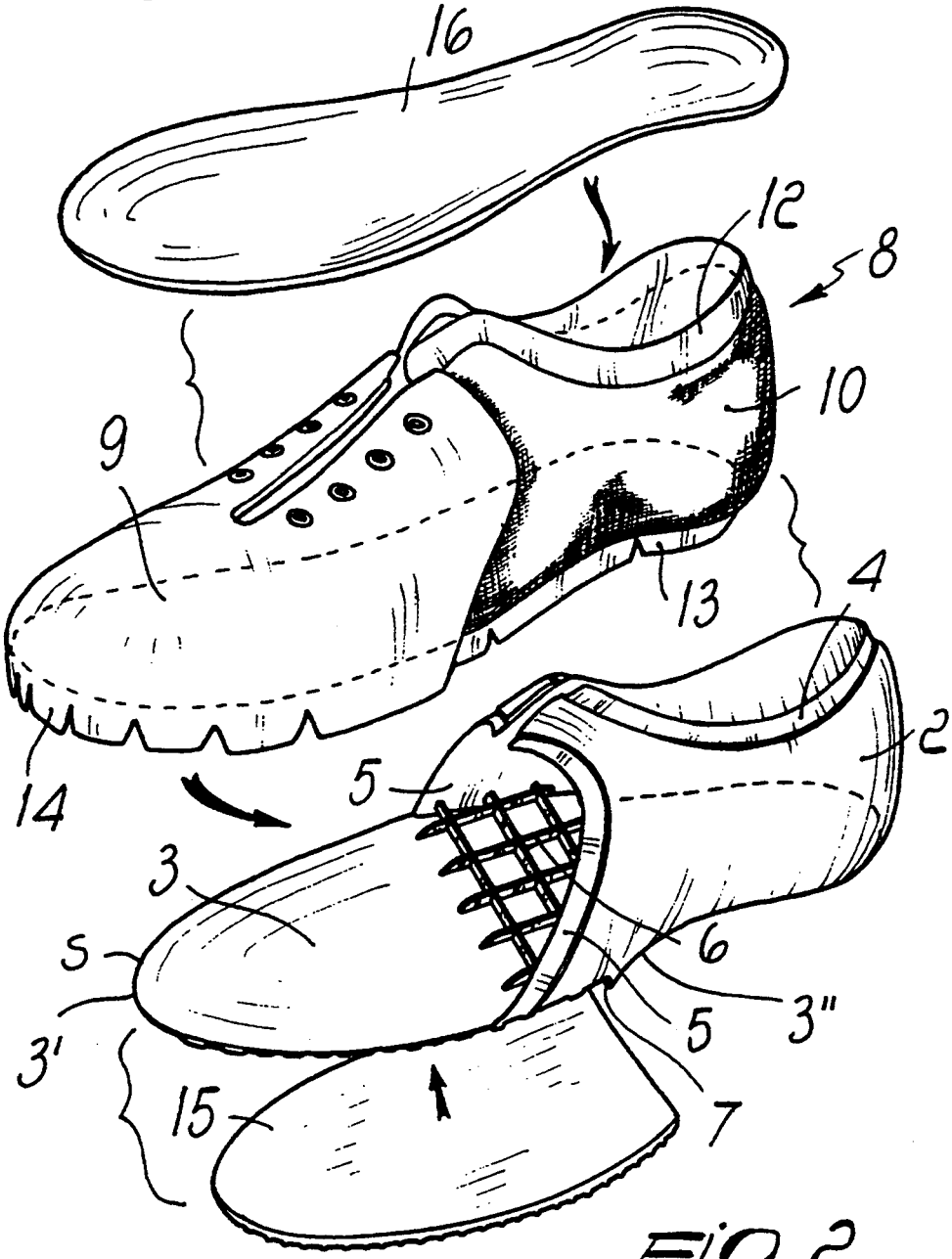
FIG. 2 is an exploded view of the footgear structure of FIG. 1.

With reference to the above FIGS. 1 to 6, a first embodiment of the footgear structure according to the invention comprises a first prefabricated one piece component, generally indicated by the reference numeral 1, which is constituted by a single part made of an injectable or castable high-performance plastic.

Said first component 1 comprises a rear upper portion 2 which has a variable thickness and extends longitudinally from the heel region of the footgear after "metatarsal" insert —or ball—, and change "from an insole" to, up to the metatarsal or ball region, and extends upwardly from a sole means 3. More precisely, the sole means 3 3' extending from the toe region T of the footgear B of the footgear up to the arch region A thereof and, integral with said partial insole, a partial sole 3'' extending from the arch region end of said partial insole up to the heel region H of the footgear.

Conveniently, the peripheral top and front edges 4 and 5 of said rear upper portion 2 are thinner than the rest to provide seam margins, whereas the sole 3'', which also acts as sole in the rear region, is stiffened in this part by a grid 6 of raised portions such as ridges arranged on its upper face.

Figure 3:
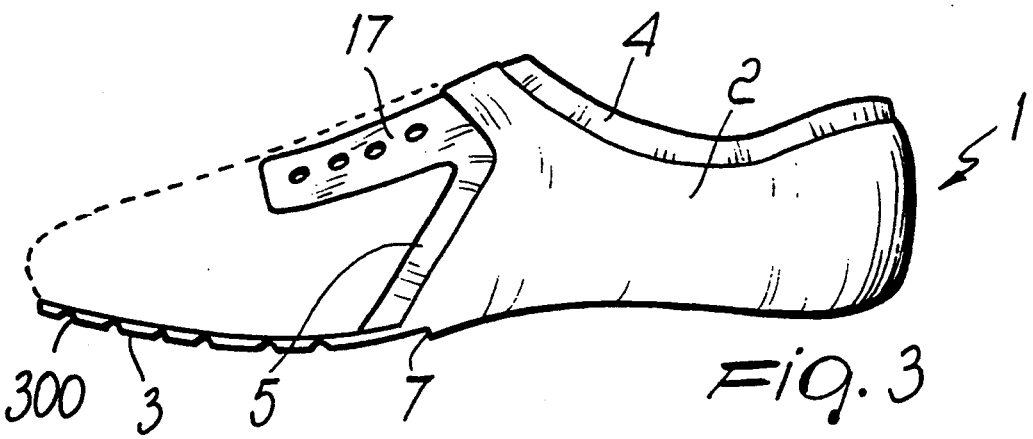
FIG. 3 is a view of one of the components of the item of footgear of FIG. 1, comprising a first structural variation.
Figure 4:
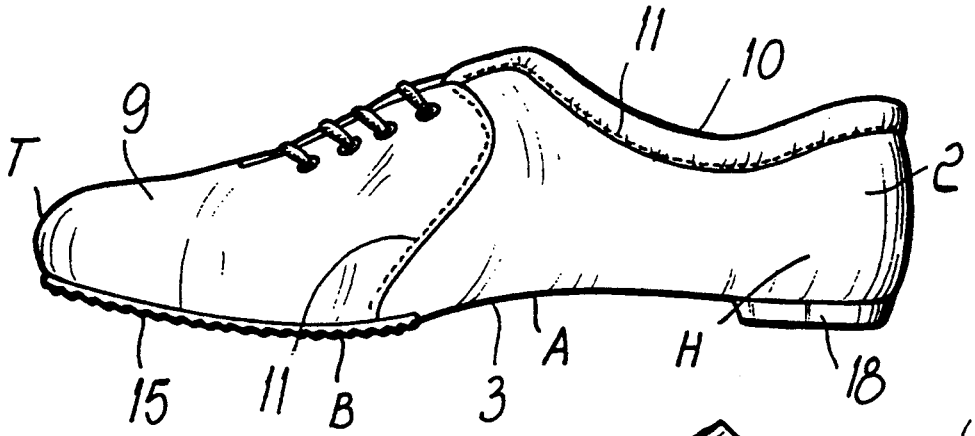
FIG. 4 is a view of an item of footgear like the one of FIG. 1, with a second structural variation.
Figure 5:
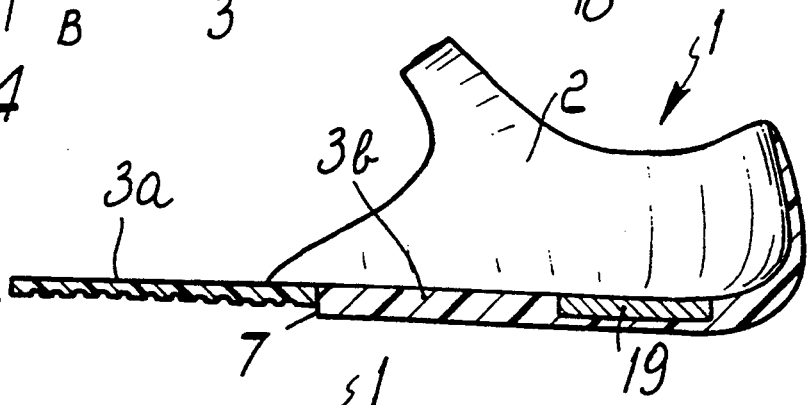
FIG. 5 is a longitudinal sectional view of one of the components of the footgear structure of FIG. 1, comprising a third structural variation.
Figure 6:
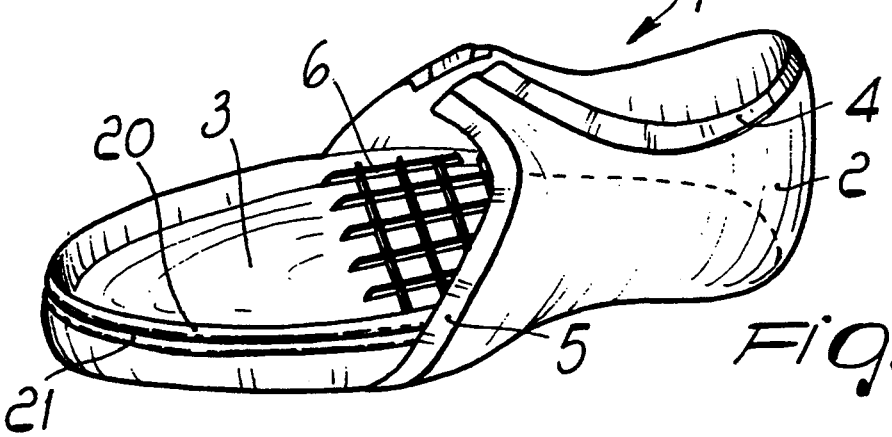
FIG. 6 is a view of one of the components of the footgear structure of FIG. 1, with a fourth structural variation.

It should be furthermore noted that the partial insole 3' is thinner than the partial sole 3'' and that its lower surface furthermore has transverse thickness reductions or sectional depressions 300, as best visible in FIG. 3, which are arranged along a series of parallel lines, so as to increase its longitudinal flexibility, and is connected with the lower surface of the partial sole 3'' by means of an abutment step 7. Note that the lower surface of the partial insole portion 3' provides surface means for connection with an outer or tread sole 15.

A second composite component of the item of footgear is generally indicated by the reference numeral 8 and comprises a front upper portion 9 made of leather, hide or of another material, and a lining 10 the rear part whereof protrudes from said front upper portion 9 and is inserted in the portion 2 made of high-performance plastic.

The second component is then joined to the first one by means of sewings 11 and/or glueings provided between perimetric or marginal surface means in the form of the joining edges of the portions 2 and 9 of the upper and between the top edge 12 of the lining 10 and the corresponding top edge 4 of the portion 2. Note that the perimetric surface means portions 11' joining the rear and the front uppers 2 and 3, respectively, extend upwardly, while the lower surface means portions 14 joining the front upper portion 9 with the sole means 3 extend along said sole means 3.

Said lining 10 also has a lower edge 13 which is folded onto the insole 3.

Said front portion 9 of the upper instead has a lower edge 14 which is folded over the perimetric edge surface S of the insole 3' and below the insole 3', in its front part, and is closed between said insole and a partial tread sole 15 which extends up to the abutment step 7.

The entire assembly is joined by glueing and/or by means of a perimetric sewing, possibly replaced by riveting or by ultrasonic welding, if the upper is made of PVC.

The item of footgear is finally completed by an inner sole 16 which is simply inserted therein in the foot resting region.

At this point it should be noted that the footgear structure according to the invention is composed of only two main elements, each of which is prefabricated i.e. comprises a portion which is already in the finished-product configuration.

The fact that one of these components is made of synthetic material, namely the first component 1, and manufactured by injection-molding or casting allows local variations in rigidity and/or flexibility simply by varying the thicknesses and/or the materials employed.

This avoids resorting to the complicated and expensive stratifications currently provided.

In particular, the component made of synthetic material assumes the configuration of a "shell", with the function of a buttress for selectively supporting and securing the heel.

This function is simply obtained, as already mentioned, by means of a diversification of the thicknesses of the molded part and by means of an anatomical configuration thereof.

All this is provided without having to resort to the manufacturing method commonly termed "assembly".

In practice, the item of footgear is "assembled" only at the metatarsal region, i.e. in the region where it has characteristics of considerable flexibility.

The component made of synthetic material furthermore has, in its rear part, such a rigidity as to keep the heel, which determines the axial alignment of the tibia and of the knee, in correct position.

The box-like structure with the grid 6 of raised portions furthermore gives the rear part a torsion-preventing function in the medial region.

Manufacture is furthermore very simple and rapid, and considering the fact that the rear part of the item of footgear is identical for various foot sizes, the manufacture of various components made of synthetic material can be performed with a single mold, simply by varying the front part thereof i.e., preselecting the desired size thereof.

This naturally entails a reduced cost for the equipment.

The same first component made of synthetic material can furthermore be common to various types of footgear, for example football, rugby, running, golf shoes etc., and this, added to the fact that the item of footgear is composed of a reduced number of parts, allows a considerable reduction in the semiworked items kept in stock.

It should be furthermore noted that the particular structure of the item of footgear gives said item characteristics of extreme lightness, added to an improved quality from the technical point of view.

It should be furthermore noted that there is no separate assembly insole made of fiberboard or leather, and that the problems related to absorptions of liquids and to deformations which occur in current items of footgear are thus avoided.

The presence of a single insole which limits the amount of material present between the sole of the foot and the ground improves the flexibility of the product and the sensitivity of the foot, and this, for example in the case of football shoes, is particularly important for a better outcome of athletic movements.

By simply extracting the inner sole it is possible to access the insole and thus access particular elements which can be fixed thereon, such as spikes in the case of track shoes, studs in the case of shoes for football, rugby, golf etc., allowing rapid and easy replacement in case of breakage.

If a rigidity of the insole exceeding the limits obtainable with the materials is required, it is possible to rivet thereon for example a metallic lamina.

Furthermore, differently from known items of footgear with a continuous shell-upper, in which transpiration of the foot is completely blocked, in this type of footgear transpiration is allowed at the front region.

Finally, the item of footgear according to the invention, differently from current ones, is highly flexible and is characterized in that it provides comfort and sensitivity to the foot.

In constructive variations, the first component of the structure can have, at the front, in the region which corresponds to the lace-holes, reinforcement elements 17 which are constituted by laminar tabs which are sewn inside the portion 9 of the second component 8 in the region to the sides of the opening with the laces.

Another variation can be constituted by a heel 18 applied on the insole 3 or defined monolithically therewith; if applied to the insole 3, said heel 18 can be directly provided for example with a pair of studs.

Further variations can be constituted by a shock-absorbing element 19 which is accommodated in the insole 3 of the first component 1 and by the fact that the insole 3 can be constituted by a plurality of parts, for example 3*a* and 3*b*, made of different but compatible materials, manufactured by successive injections in a mold.

This solution is practically impossible for items of footgear of the "assembled" type, since the assembly insole on which they are assembled must be continuous and rigid.

In a further variation, the insole 3 has, in the front region, an upper edge 20 to the side of which the edge of the second component, which is no longer directed downward, is placed and sewn.

In order to facilitate sewing, the edge 20 has a reduced-thickness groove 21 thereby forming a containment edge.

Figure 7:
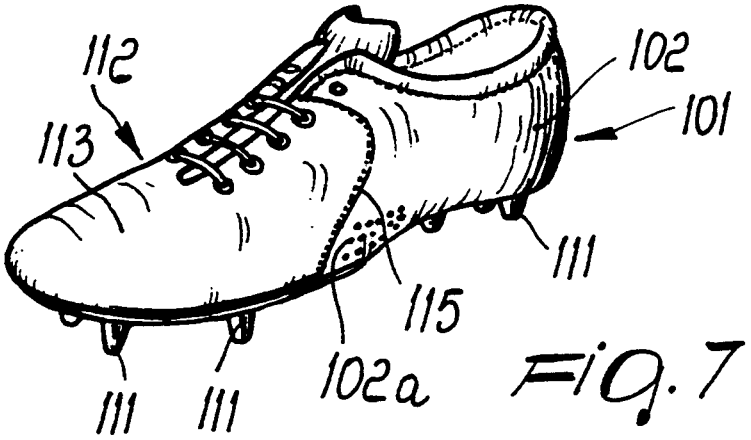
FIG. 7 is an overall perspective view of a second embodiment of the footgear structure according to the invention, shaped like a football shoe.
Figure 8:
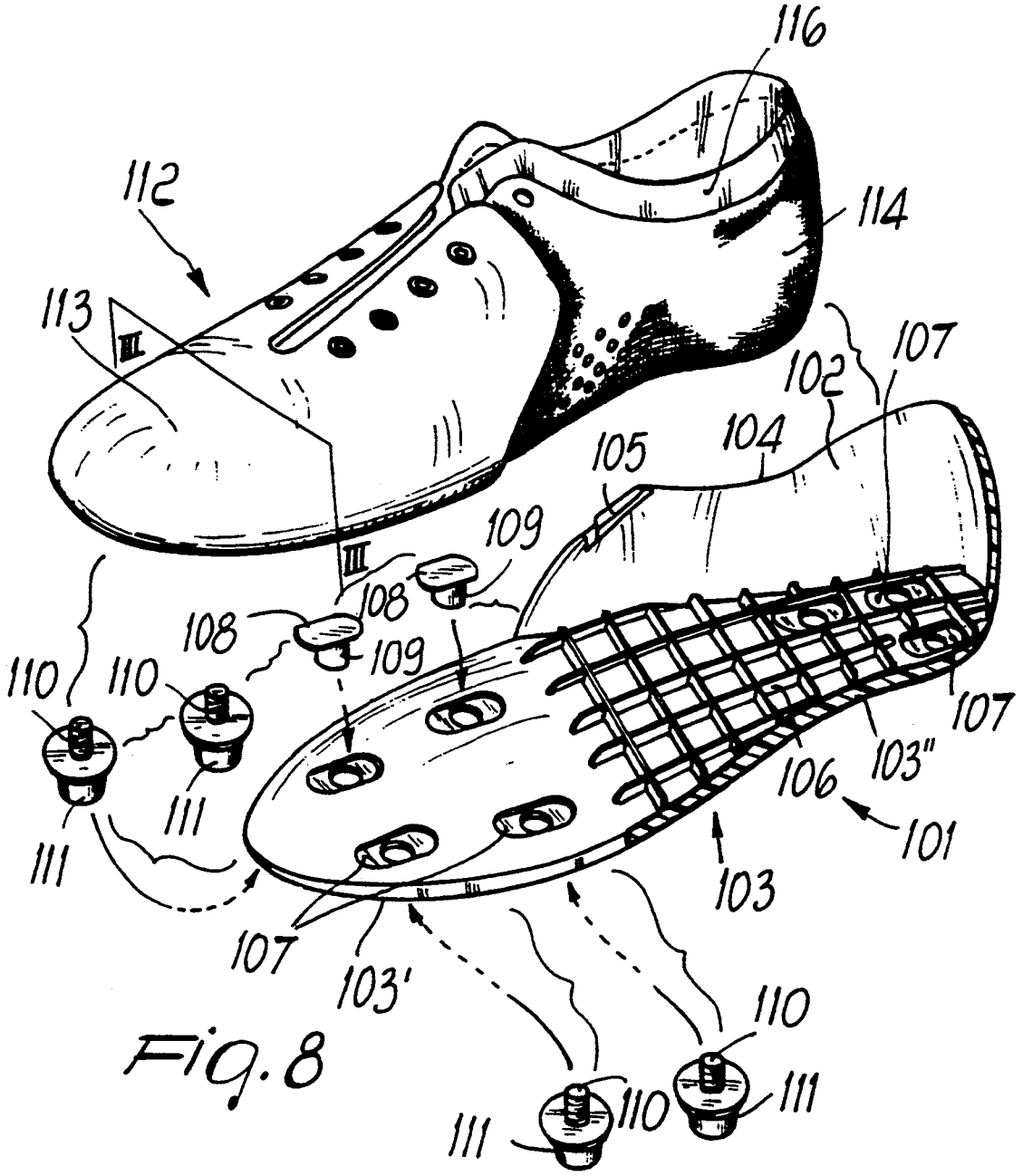
FIG. 8 is an exploded perspective view of the footgear structure of FIG. 7.
Figure 9:
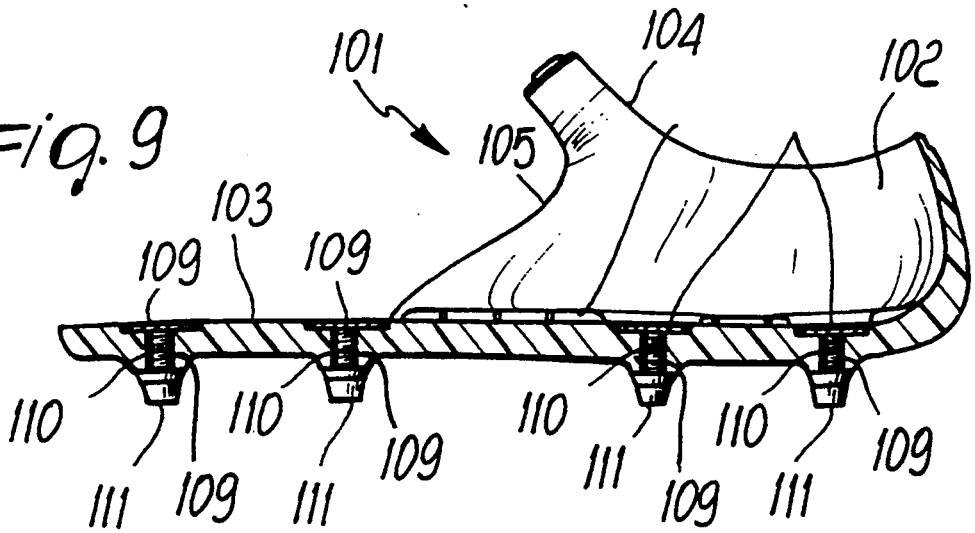
FIG. 9 is a longitudinal sectional view of the footgear structure of FIG. 7.

With reference now to the above mentioned FIGS. 7 to 9, a second embodiment of the footgear structure according to the invention, in a configuration for football, comprises a first component, generally indicated by the reference numeral 101, which is constituted by a single part made of injectable or castable high-performance plastic.

Said part can be conveniently manufactured by means of successive injections and/or castings in a mold and/or glueings of materials with different characteristics, so as to obtain regions with differentiated mechanical strength.

Said first component 101 is constituted by a rear upper portion 102 which has a variable thickness, possibly provided with aeration holes 102*a*, which extends up to the metatarsal region from sole means 103 which also includes an insole portion 103' and a sole portion 103" defining the tread sole.

The top and front edges 104 and 105 of the rear upper portion 102 are thinner than the rest, whereas the insole 103 is stiffened in the rear region by a grid 106 of raised portions arranged on its upper face.

In this embodiment, said insole 103 includes, at the upper surface, seats 107, obtained with the same molding operation by means of which said insole is manufactured, for complementarily shaped plates 108, conveniently metallic ones, each of which supports an internally threaded tubular protrusion 109 which is suitable for being inserted in a corresponding hole of said insole 103.

Each protrusion 109 is suitable for the screwing of a threaded pin 110 which protrudes from a stud 111.

Conveniently, the studs 111 are screwed by means of conventional wrenches, and the profiles of the plates 108 and of the seats 107 are defined so that the rotation of the protrusion 109 is prevented.

In this embodiment, the plates 108 are executed with a substantially disk-like shape with two diametrically opposite straight portions.

Figure 12:
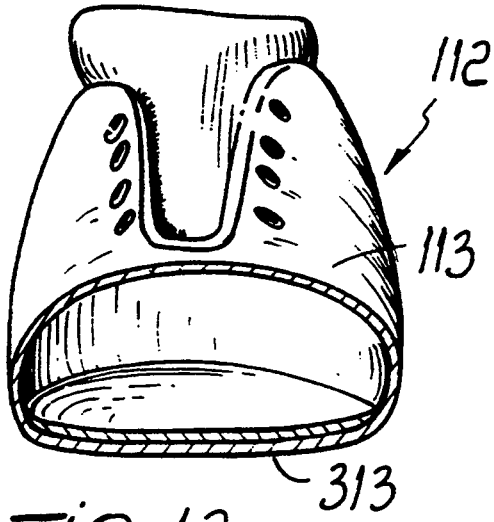
FIG. 12 is a transverse sectional view, taken along the plane III—III of FIG. 8.

A second component of the football shoe is generally indicated by the reference numeral 112 and comprises a front upper portion 113, of a tubular type, made of leather, hide or of another material, and an equally tubular lining 114 the rear part whereof protrudes from said portion 113 and is inserted in the portion 102 made of high-performance plastic. It should be noted that the tubular shape of the front upper portion 113 is defined at the bottom side thereof by lower surface means 313 (FIG. 12) extending continuously over the bottom side of said front upper portion 113 and integrally joining the lateral walls thereof.

The second component 112 is joined to the first one simply by overlapping and by means of sewings 115 and/or glueings and/or rivetings and/or ultrasonic weldings, if the materials are compatible, defined between the joining edges of the upper portions 102 and 113, between the upper edge 116 of the lining 114 and the corresponding upper edge 104 of the portion 102, and between the lower parts of the upper 113 and of the lining 114 and the insole 103 made of high-performance plastic.

Figure 10:
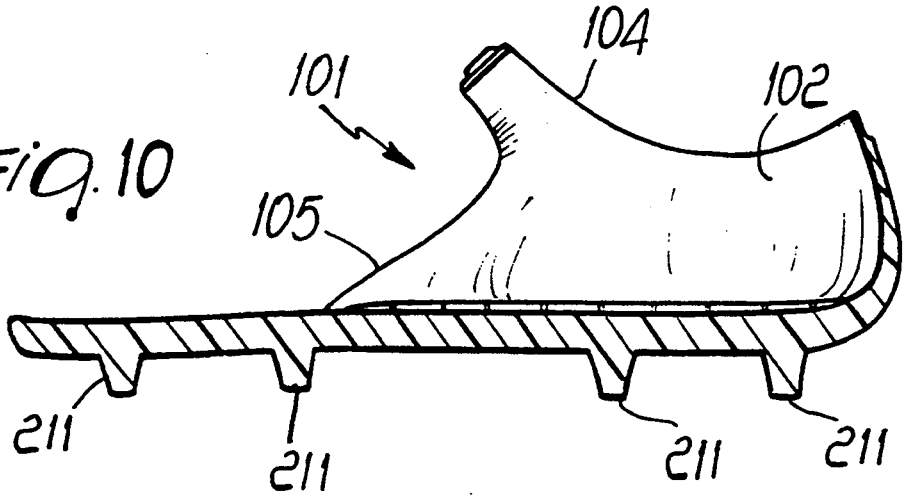
FIG. 10 is a longitudinal sectional view of a further embodiment of a first component of the structure of FIG. 7, with the studs fitted.
Figure 11:
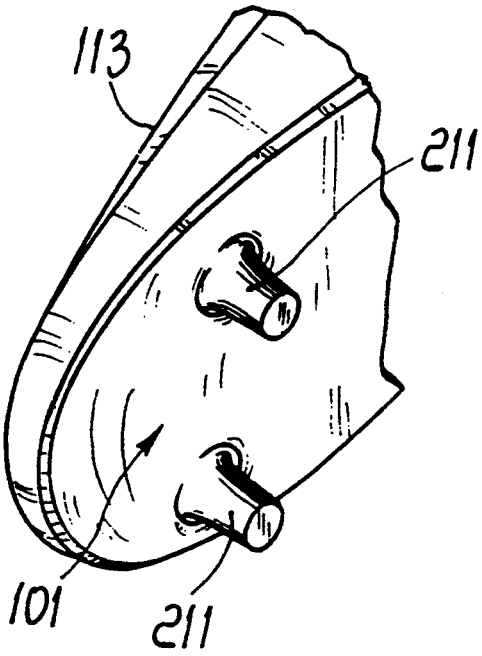
FIG. 11 is a detail bottom view of the front region of a footgear structure with the component of FIG. 10.

With reference now to the above mentioned FIGS. 10 and 11, in a variation of the second embodiment of the footgear structure, the studs, now indicated by 211, are monolithic with the insole 103 and are thus manufactured by the same molding operation by means of which said insole is produced.

Naturally, no replacement of the studs is possible in this case.

In any case, metallic heads with a self-threading stem can be mounted on the tips of the studs.

In other embodiments not illustrated in the figures, the studs can be constituted by rubber inserts which are conveniently arranged in the mold prior to the injection of the first component 101.

Figure 13:
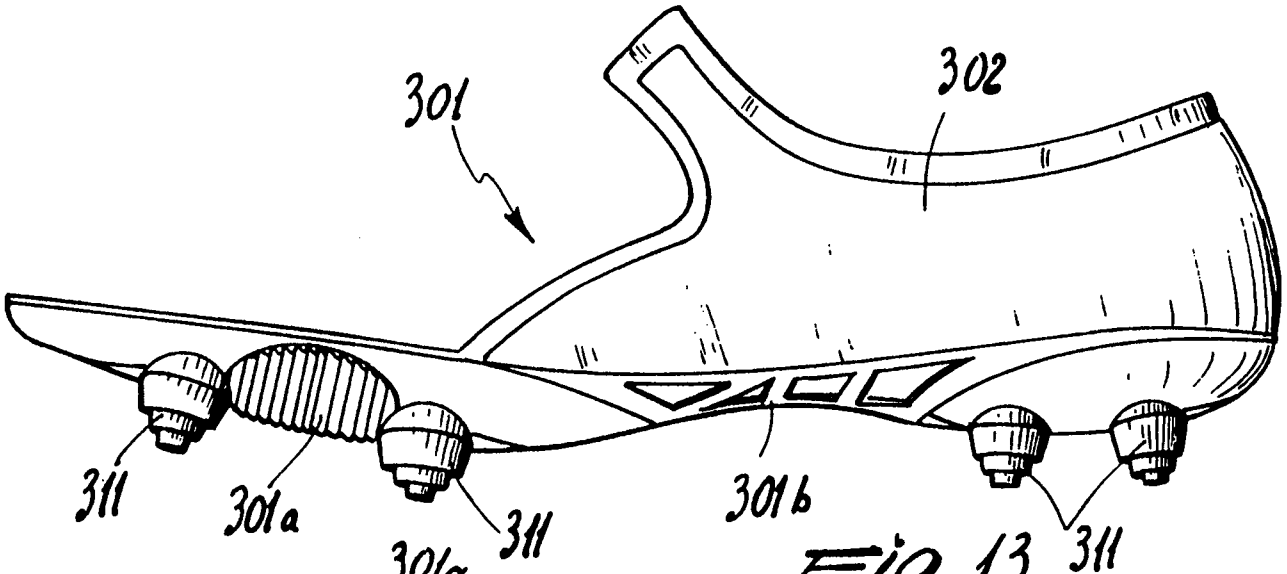
FIG. 13 is a side view of another further embodiment of the first component related to the structure of FIG. 7.
Figure 14:
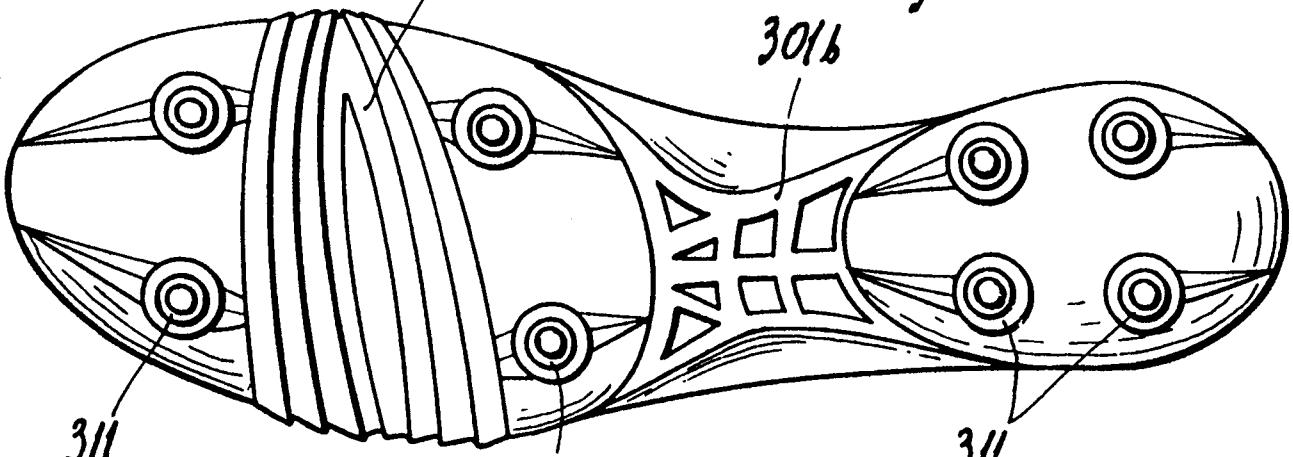
FIG. 14 is a bottom view of the first component of FIG. 13.

In the particular embodiment suitable for use as a football shoe, with reference now to the above mentioned FIGS. 13 and 14, the structure of the first component 301 can comprise three different types of material, arranged in the different regions and joined by glueing or molding in place.

For example, the front bending region 301*a* and the studs 311 can be made of a very soft material, the region 301*b* of the plantar arch and of the heel can be made of a rigid stiffening material, and the rear upper part 302 can be made of a soft material.

The molding in place operation can comprise for example rubber/polyurethane and/or rubber/pebax.

It is furthermore possible to fit on the sole a complete tread, possibly already monolithically provided with the studs, or one or more tread portions with different characteristics, for example one for the front region and one for the rear region.

In any case, all or part of the sole can already constitute the tread.

It should be also noted that even in this case the structure of the item of footgear is composed of only two main elements, each of which comprises a portion which already has the configuration of the finished product.

The manufacturing process therefore consists substantially in molding the first component 101, which includes the sole with tread provided with heels, studs or stud fixing elements.

The second tubular component is then simply applied on the first component and joined to it.

In this manner, the assembly insole is no longer used and therefore the operations for fixing the upper on said insole and for carding to assemble the sole are eliminated.

In this type of manufacture, the upper-holding last has the exclusive purpose of constituting a support for said upper.

The manufacturing process is therefore no longer constituted by a series of consecutive steps which occur at the upper-holding last, but is simply constituted by the joining of two semiworked items appropriately manufactured in different facilities even with completely different technologies.

In this manner, the possibilities of automation are increased and the possibilities of errors are simultaneously reduced.

This leads to a rationalization both of production and of costs.

For example, various types of the second component can be assembled to a same type of first component made of synthetic material, and vice versa various types of the first component can be assembled to a same type of second component in order to manufacture items of footgear having different characteristics related to commercial and production requirements.

It should be noted that manufacture is very simple and rapid, in particular for the first component made of synthetic material, and considering that the rear part -of the item of footgear is very similar for various foot sizes, the production of various components made of synthetic material can be perforated with a single mold simply by varying the front part thereof.

This naturally means a reduced cost for the equipment.

It should furthermore be noted that the manufacture of a component made of synthetic material by injection-molding or casting allows local variations in rigidity and/or flexibility simply by varying the thicknesses and/or the materials employed.

In its rear part, said component is furthermore manufactured so as to have such a rigidity as to keep the heel, which determines the axial alignment of the tibia and of the knee, in correct position.

In practice it has thus been observed that the footgear structure according to the invention has achieved the intended aim and objects of the present invention.

The invention thus conceived is susceptible to numerous modifications and variations, all of which are within the scope of the inventive concept.

All the details may furthermore be replaced with other technically equivalent elements.

In practice, the materials employed, so long as compatible with the contingent use, as well as the dimensions, may be any according to the requirements.

I claim:

1. Footgear structure having a toe region, a ball region, an arch region and a heel region, the structure including a prefabricated one piece first component of synthetic material and a prefabricated composite second component of pre-selected size, wherein:

said first component includes:

a sole comprising integral therewith a partial insole portion and a partial sole portion, said partial insole portion extending from the toe region of the footgear over the ball region of the footgear up to the arch region thereof, said partial sole portion extending from the arch region end of said partial insole portion up to the heel region of the footgear, integral with said sole, a first upper portion longitudinally extending from the ball region of the footgear up to the heel region thereof and extending upwardly from said sole, said partial insole portion being flexible and thinner than said partial sole portion and having a perimetric edge surface for cooperation with said second component and a lower surface defining surface means for connection with a tread sole, said second component includes:

a second upper portion extending from the toe region of the footgear up to said first upper portion, said second upper portion having upwardly extending perimetric surface means portions for connection with said first upper portion and lower surface means portions extending along said sole for connection with said means, a lining for said second upper portion, said lining including a rear lining part protruding beyond said second upper portion towards the heel region of the footgear, said rear lining part being inserted in said first upper portion of said first component and having marginal surface means for connection with said first upper portion.

2. A footgear structure according to claim 1, further comprising an inner sole inserted therein above said sole of the footgear and a partial tread sole, wherein said second upper portion has a lower marginal edge fixed to said partial insole and wherein said partial tread sole is fixed to said partial insole portion.

3. A footgear structure according to claim 2, wherein said lower surface means of said second upper portion are folded below said partial insole portion and are fixed between said partial insole portion and said tread sole.

4. A footgear structure according to claim 3, wherein said perimetric edge surface of said partial insole portion is in the form of a containment edge, said lower surface means of said second upper portion being fixed inside said containment edge.

5. A footgear structure according to claim 1, wherein said first upper has thinned top and front edges providing marginal seam surfaces for surface connection with said perimetric surface means of said second upper portion and marginal surface means of said lining.

6. A footgear structure according to claim 3, wherein said surface connection is selected from the group of techniques consisting of sewing, gluing, riveting and ultrasonic welding.

7. A footgear structure according to claim 1, wherein said partial sole portion has a stiffening grid of ridges.

8. A footgear structure according to claim 1, further comprising an abutment step between said partial insole portion and said partial sole portion.

9. A footgear structure according to claim 1, wherein said partial insole portion has a series of transverse sectional depressions arranged along substantially parallel lines.

10. A footgear structure according to claim 1; wherein said first component of synthetic material is constituted by a plurality of component parts made of different synthetic molding materials.

11. A footgear structure according to claim 1, wherein said lower surface means of said second upper portion extend continuously over the bottom side of said second upper portion thereby defining a tubular shape of said second upper portion and wherein said lining is tubular.

12. A footgear structure according to claim 1, wherein said first prefabricated one piece component is made of high-performance plastics by injection.

13. A footgear structure according to claim 1, wherein said first prefabricated one piece component is made of high-performance plastics by casting.

14. A footgear structure according to claim 1, wherein said first prefabricated one piece component is made of successively molded materials of different characteristics.

15. A footgear structure according to claim 1, wherein said first prefabricated one piece component has a portion thereof located in said toe and ball region of the footgear structure made of very soft material, a further portion thereof located in said arch and heel regions of the footgear structure made of rigid material and has said first upper portion thereof made of soft material.

16. A footgear structure according to claim 1, wherein said sole has seats for heel members and studs.

17. A footgear structure according to claim 1, further comprising studs fixed on said sole.

18. A footgear structure according to claim 17, wherein said studs have tips in the form of metallic heads with self-threading stems.

19. A footgear structure according to claim 17, wherein said studs are monolithic with said sole :means.

20. A footgear structure according to claim 17, wherein said studs are constituted by molding inserts embedded in said sole.

21. A footgear structure according to claim 1, wherein said sole include seats for plate elements with internally threaded protrusions passing through said sole and studs with threaded pins screwed within said protrusions.

22. A footgear structure according to claim 1, wherein said first upper portion has a variable thickness for selectively supporting and securing the heel of the user's foot.

23. A footgear structure according to claim 1, wherein said first upper portion has aeration holes.

24. A footgear structure according to claim 1, further comprising a shock-absorbing element within said sole.

25. A footgear structure having a toe region, a ball region, an arch region and a heel region, the structure including a prefabricated one piece first component of synthetic material and a prefabricated composite second component of pre-selected size, wherein:

said first component includes:

a sole comprising integral therewith a partial insole portion and partial sole portion and further comprising an abutment step between said partial insole portion and said partial sole portion, said partial insole portion extending from the toe region of the footgear over the ball region of the footgear up to the arch region thereof, said partial sole portion extending from the arch region end of said partial insole portion up to the heel region of the footgear and having a stiffening grid of ridges, integral with said sole, a first upper portion longitudinally extending from the ball region of the footgear up to the heel region thereof and extending upwardly from said sole, a tread sole fixed below said partial insole portion and abutting against said abutment means, an inner sole inserted above said sole of the footgear, said partial insole portion being flexible and thinner than said partial sole portion and having a perimetric edge surface for cooperation with said second component and a lower surface defining surface means for connection with said tread sole, said second component includes:

a second upper portion extending from the toe region of the footgear up to said first upper portion, said second upper portion having upwardly extending perimetric surface means portions for connection with said first upper portion and lower surface means portions extending along said sole for connection with said sole, a lining for said second upper portion, said lining including a rear lining part protruding beyond said second upper portion towards the heel region of the footgear, said rear lining part being inserted in said first upper portion of said first component and having marginal surface means for connection with said first upper portion.

26. A footgear structure according to claim 25, wherein said upwardly extending surface means portion of said second upper portion is connected with said first upper portion at a region extending upwardly from said ball region of the footgear.

* * * * *

UNITED STATES PATENT AND TRADEMARK OFFICE

CERTIFICATE OF CORRECTION

PATENT NO. : 5,339,544

DATED : August 23, 1994

INVENTOR(S) : Alberto Caberlotto

It is certified that error appears in the above-identified patent and that said Letters Patent is hereby corrected as shown below:

Column 3, lines 21-23, delete "after 'metartarsal' insert —or ball—, and change 'from an insole' to".

Column 3, line 25, between "3" and "3'" insert –comprises a partial insole portion–.

Column 3, lines 25-26, after first occurrence of "footgear" insert –over the ball region–.

Column 3, line 36, after "insole" insert –portion–.

Column 6, line 2, delete the word "insole" and substitute therefor –sole means–.

Column 6, line 5, delete the word "insole" and substitute therefor –sole means–.

Column 7, line 53, delete the word "perforated" and substitute therefor –performed–.

Column 8, line 41, delete the word "means" and substitute therefor –sole–.

Signed and Sealed this

Sixth Day of June, 1995

*Attest:*

Bruce Lehman

BRUCE LEHMAN

*Attesting Officer*

*Commissioner of Patents and Trademarks*